US007207137B2

(12) United States Patent
Wagner

(10) Patent No.: US 7,207,137 B2
(45) Date of Patent: Apr. 24, 2007

(54) SET OF COMPONENTS USED FOR THE PRODUCTION OF LOAD-BEARING STRUCTURES FOR GRATINGS

(75) Inventor: Georg Wagner, Bruchsal (DE)

(73) Assignee: F.von Langsdorff Licensing, Ltd., Inglewood, Ontario (CA)

( * ) Notice: Subject to any disclaimer, the term of this patent is extended or adjusted under 35 U.S.C. 154(b) by 256 days.

(21) Appl. No.: 10/965,223

(22) Filed: Oct. 15, 2004

(65) Prior Publication Data

US 2005/0155321 A1 Jul. 21, 2005

Related U.S. Application Data

(63) Continuation of application No. PCT/EP03/03841, filed on Apr. 14, 2003.

(30) Foreign Application Priority Data

Apr. 15, 2002 (DE) ..... 102 16 914

(51) Int. Cl.
*A01G 13/02* (2006.01)
*A01G 9/00* (2006.01)

(52) U.S. Cl. ..... 47/32.4; 47/32

(58) Field of Classification Search ..... 47/20.1, 47/29.2, 31.1, 32, 32.7
See application file for complete search history.

(56) References Cited

U.S. PATENT DOCUMENTS 4,577,449 A 3/1986 Celli
4,777,774 A 10/1988 Smalley, III

FOREIGN PATENT DOCUMENTS

| | | | |
|---|---|---|---|
| DE | 35 43 861 | A1 | 7/1986 |
| DE | 197 07 355 | A1 | 10/1987 |
| DE | 88 05 949.9 | U1 | 9/1988 |
| DE | 199 40 911 | C1 | 1/2001 |
| DE | 10055496 | A1 * | 5/2002 |
| FR | 2668029 | A3 * | 4/1992 |
| WO | WO9744996 | A * | 12/1997 |

OTHER PUBLICATIONS

Derwent Abstracted Publication No. KR2002030440A;□□Kang et. al.; □□Base Frame for Protecting Tree and Tree Protection Method Using the same and Permeable Concrete.□□Derwent Account No. 2002-653002.*

* cited by examiner

*Primary Examiner*—Francis T. Palo
(74) *Attorney, Agent, or Firm*—Cahn & Samuels, LLP

(57) ABSTRACT

The invention relates to a set of components used for producing a load-bearing structure for gratings, comprising pillars and support beams which are removably connected to the pillars via couplings. Flat network-type supporting frames of variable sizes can be formed by using couplings that preferably comprise four connecting elements which are arranged in a cruciform manner for the corresponding connecting elements of the supporting beams. A vertical space can be created between two supporting frames by means of spacers that are disposed on the pillars.

15 Claims, 4 Drawing Sheets

Figure 1:
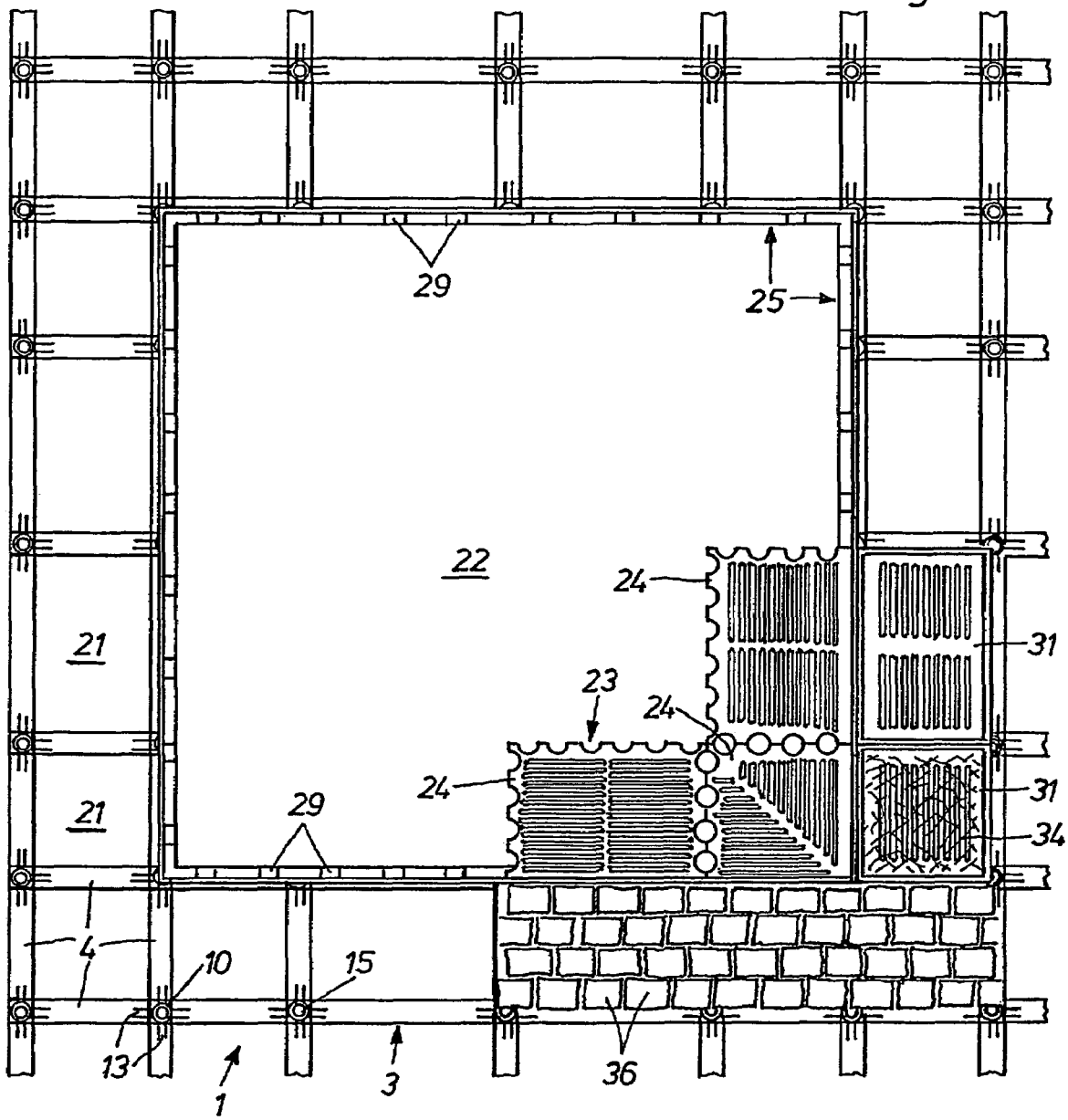

23
24
28
36
30
29
35
26
25
27
34
32
6
4
33
31
5

6
14
12
10
14
6
5
18
18
5
4
7
8
13
14
11
13
14
13
8
7
4
20
15

4
6
4
14
9
11
15
19
13
6
13
5
14
8
10
12
8
18
13
7
4
4

SET OF COMPONENTS USED FOR THE PRODUCTION OF LOAD-BEARING STRUCTURES FOR GRATINGS

This invention pertains to a kit conforming to the definition of the species of claim 1.

Patent DE 197 07 355 A1, which was taken into consideration when defining the species of claim 1, has made known a kit for the variable design of supporting and/or separating elements in the building trade. This kit consists of vertical posts propped up on the ground and straight or arc-shaped supporting bars. The end sections of these supporting bars are only half as thick as the remaining section of the bars and have through-holes. The supporting bars are pushed onto the posts, alternating their direction, so that the posts pass through the holes, and the upper and lower end sections of two supporting bars overlap. In this way a first supporting frame is made at the lower end of the posts and, after pushing spacers onto the posts, a second supporting frame is made at their upper end. Both supporting frames have even top and bottom surfaces. A tree protection grille comprising inter-connected rectangular or segment-shaped sections is mounted on the top surface of the upper supporting frame and may be rectangular, semi-circular or circular in shape.

Since a form-locking connection is established between the supporting bars and the posts of this kit, extremely sturdy supporting structures may be produced in this way for tree protection grilles which are capable in absorbing not only strong vertical forces, but in particular strong horizontal forces as well. As a result, such supporting structures may be used in conjunction with portable tree protection grilles to produce covers for circular beds around trees over which vehicles may pass and which will withstand even the powerful side forces caused by starting and braking such vehicles.

The supporting structures may have open sides so as to provide openings through which the roots may grow. For this purpose the upper supporting frame which bears the tree protection grille, as mentioned before, is propped up on the lower supporting frame by spacers. As an alternative, closed vertical separating walls may be produced by filling up the interspace between the upper and lower supporting frames with bars having the same shape and size as the supporting bars used for the upper and lower supporting frames.

When producing such supporting structures with the aid of supporting bars extending lengthwise and crosswise a large number of T- and cross-shaped intersections appear in the supporting frames. In this case, however, only two supporting bars may be positioned on the same level or make up this level. e.g. the contact surface of the upper supporting frame. Therefore the third and possibly fourth supporting bar must consequently be offset vertically from the first and second supporting bars by the thickness of a bar. This requires filling up the space between the lower supporting bars and the contact level of the higher supporting bars with bar-type spacers. However since these spacers cannot be pushed onto the posts, they must be secured in position in some other way. The same applies to making separating walls bordering on T- and cross-shaped intersections. This means that the difference in thickness of the supporting bars occurring at the lower supporting frame must likewise be compensated for by spacers.

As the length of the spacers must be adapted to the length of the supporting bars the same number of supporting bars of different lengths and shapes is required as there are supporting bars of different lengths and shapes. As a result, the complete kit comprises a large variety of different construction elements.

The different heights of the supporting bars which occur at every T- and cross-shaped intersection in the lower and upper supporting frames and the additional requirement to use bar-type spacers have the additional disadvantage that the openings provided for the growth of roots may be smaller than is desirable for an unhindered growth of the roots of the trees involved.

Patent DE 88 05 949 U1 has made known a kit for producing a root protection bridge for trees designed so that the corners of pre-fabricated plate elements rest on the front side of foundation posts arranged in a dot screen. To make sure that the plate elements will be positioned on the foundation posts with maximum accuracy, a cross-shaped adjusting template is mounted on their front side. However since the foundation posts rest on the ground of the root area only with their base plates, and the plate elements also have but a loose contact with the foundation posts, a supporting structure of this type cannot absorb strong side forces. Additional disadvantages are that the use of pre-fabricated plate elements allow only a limited scope for variations, and the heavy weight of the plate elements requires the employment of lifting gears.

It is therefore the object of this invention to provide a kit for the variable design of supporting structures consisting of posts and supporting bars which are stable both vertically and horizontally. Intended for covering grilles and vertical separating walls, this kit is particularly suitable for large-sized supporting frames which have a large number of intersections involving several intersecting supporting bars each. This object is accomplished by the characteristics specified in claim 1.

The provision to use couplings to connect supporting bars with posts makes it possible to construct net-type supporting frames of any desired size made up of straight supporting bars extending lengthwise and crosswise on the same level. The couplings positioned on the same level may comprise at least two connecting pieces arranged opposite or at right angles to each other, three connecting pieces arranged in T shape, yet preferably four connecting pieces arranged in cross shape. In the border area couplings made up of three connecting pieces forming a T, and in the corner area couplings consisting of two connecting pieces forming a right angle may be used. When using couplings comprising four connecting pieces arranged in cross shape in the border and corner areas of a supporting frame, this supporting frame may be extended lengthwise and crosswise, as desired, without first having to remove the supporting bars or to exchange the couplings used in the border or corner areas.

As the supporting bars positioned on the same level make up a supporting frame having an even bearing surface, the tree protection grilles and the border-strip frames supporting them may be placed on the supporting frame without using any spacers. In the same manner vertical separating walls may be produced between the lower and the upper supporting frames without the use of spacers.

Since the use of couplings makes it possible to produce large-sized net-type supporting structures in an extremely simple manner, the kit specified in this invention is particularly well suited for producing additional supporting grilles bordering on the tree protection grille, e.g. for pavements provided on a supporting frame. To ensure that the top surface of such pavement will be on the same level as the top surface of the adjoining tree protection grille, a border-strip frame of adequate height is used for the tree protection grille which is to make up for the difference in height between the higher pavement and the lower tree protection grille.

If a supporting frame segment made of arc-shaped supporting bars is to be fitted into a larger supporting frame consisting of straight supporting bars extending lengthwise and crosswise, so that the arc-shaped border-strip frame is to rest on the arc-shaped supporting bar over its entire length, the arc-shaped supporting bars are integrated into the level of the supporting frame comprising straight supporting bars, while arc-shaped supporting bars which intersect with the straight supporting bars will be offset in height in relation to these and will be connected with them by means of a separate coupling, as specified in claim 2.

According to claim 3, straight supporting bars extending diagonally may be used in the outer-edge area of segment-shaped covering grille sections for integrating such sections into supporting frames consisting of supporting bars extending lengthwise and crosswise. These straight supporting bars extending diagonally are positioned on the same level as the supporting frame and are connected with couplings having a correspondingly larger number of connecting pieces. In this case the outer edge of the segment-shaped covering grille sections or of the arc-shaped sections of the border-strip frame are supported by a large number of intersecting supporting bars which also provide a reliable support. In addition, the diagonal supporting bars add stability to the entire supporting structure which reinforces its capability of withstanding forces acting horizontally.

The construction principle specified in claim 4 according to which the connecting pieces of the couplings and the supporting bars are shaped as butt straps extending vertically makes for an extremely simple and stable connection. In the further development according to claim 5 the stability of the connection is increased even more because the frictional connection resulting from the application of screws is complemented partially by a form-locking connection. This form-locking connection is rendered more effective by the profile of the butt straps coming into contact with each other, as specified in claim 6. Sub-claims 7 through 9 describe advantageous further developments in design.

Figure 2:
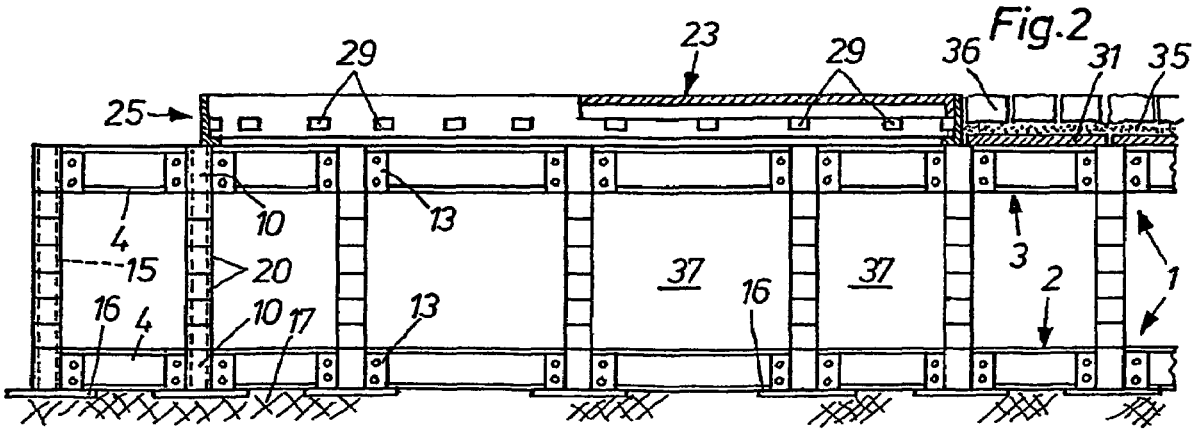
Figure 3:
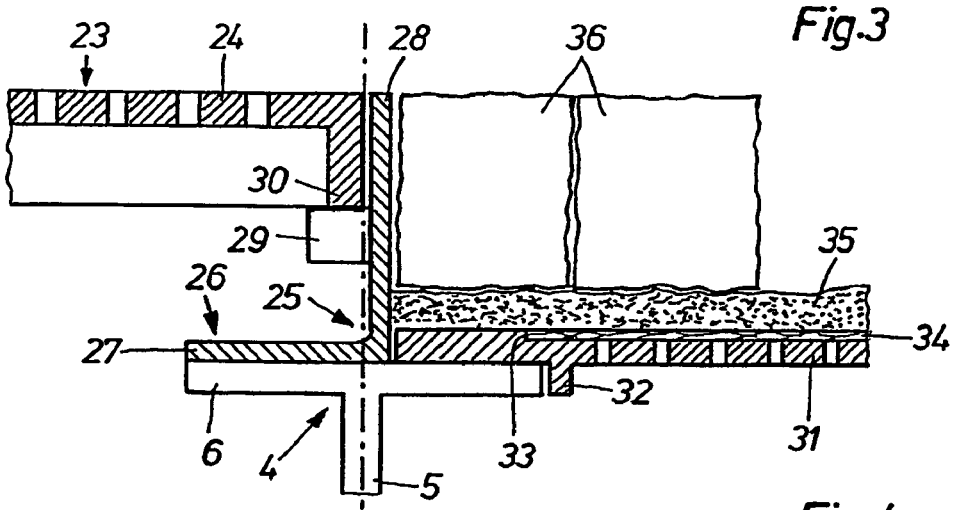
Figure 4:
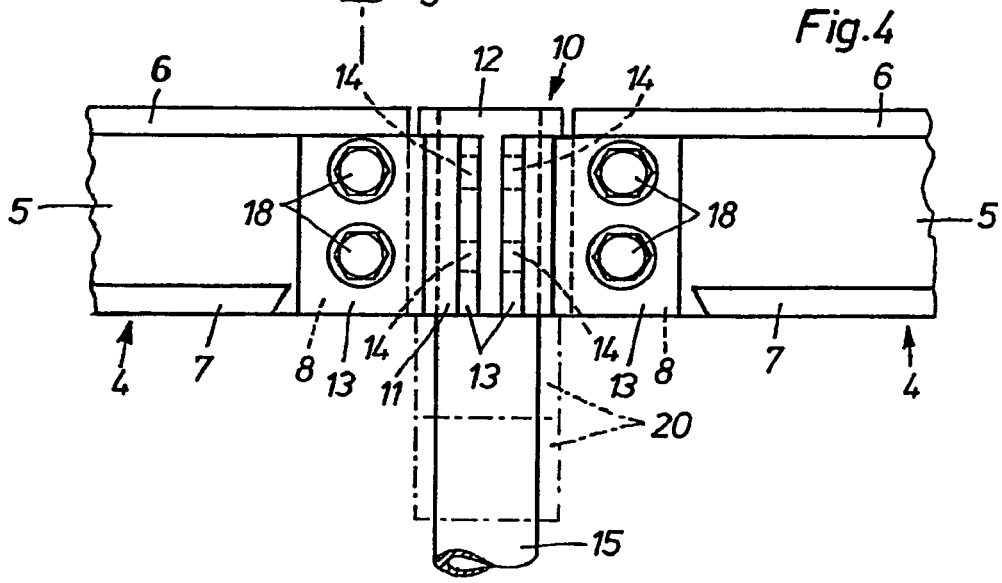
Figure 5:
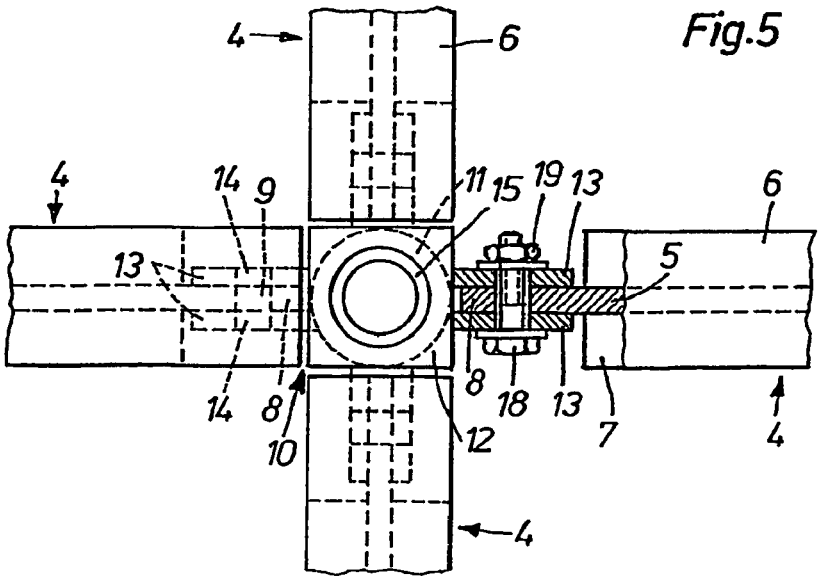
Figure 6:
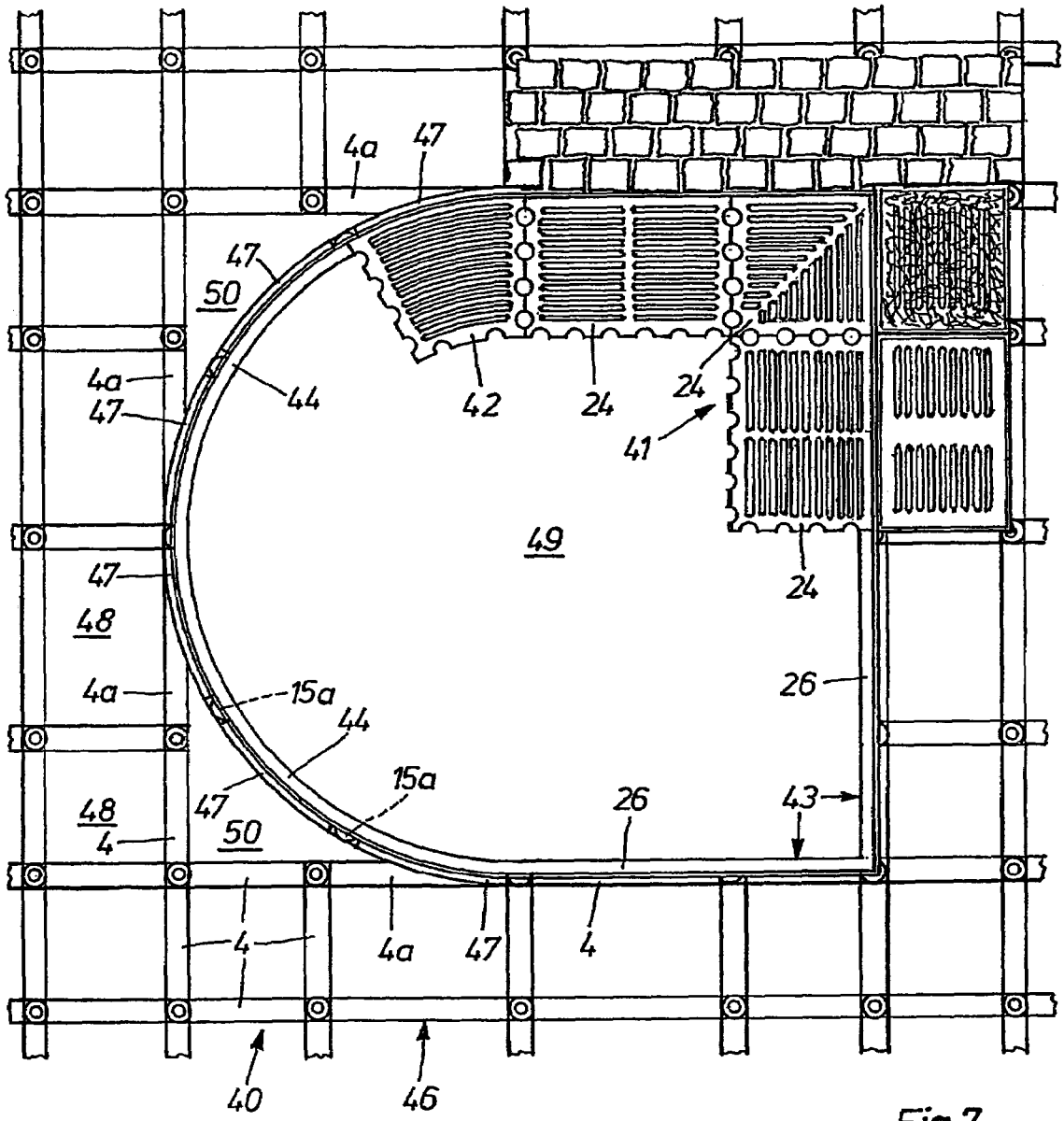
Figure 7:
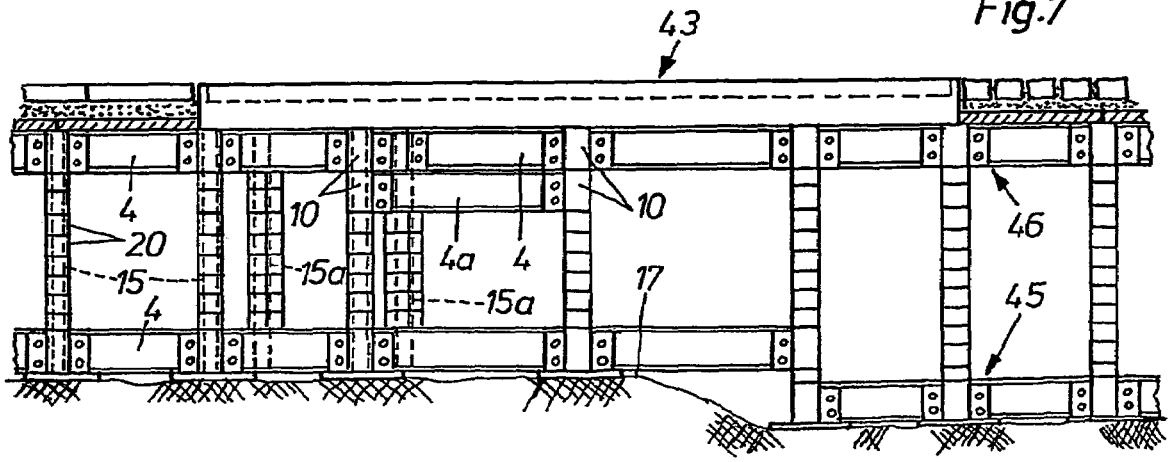
Figure 8:
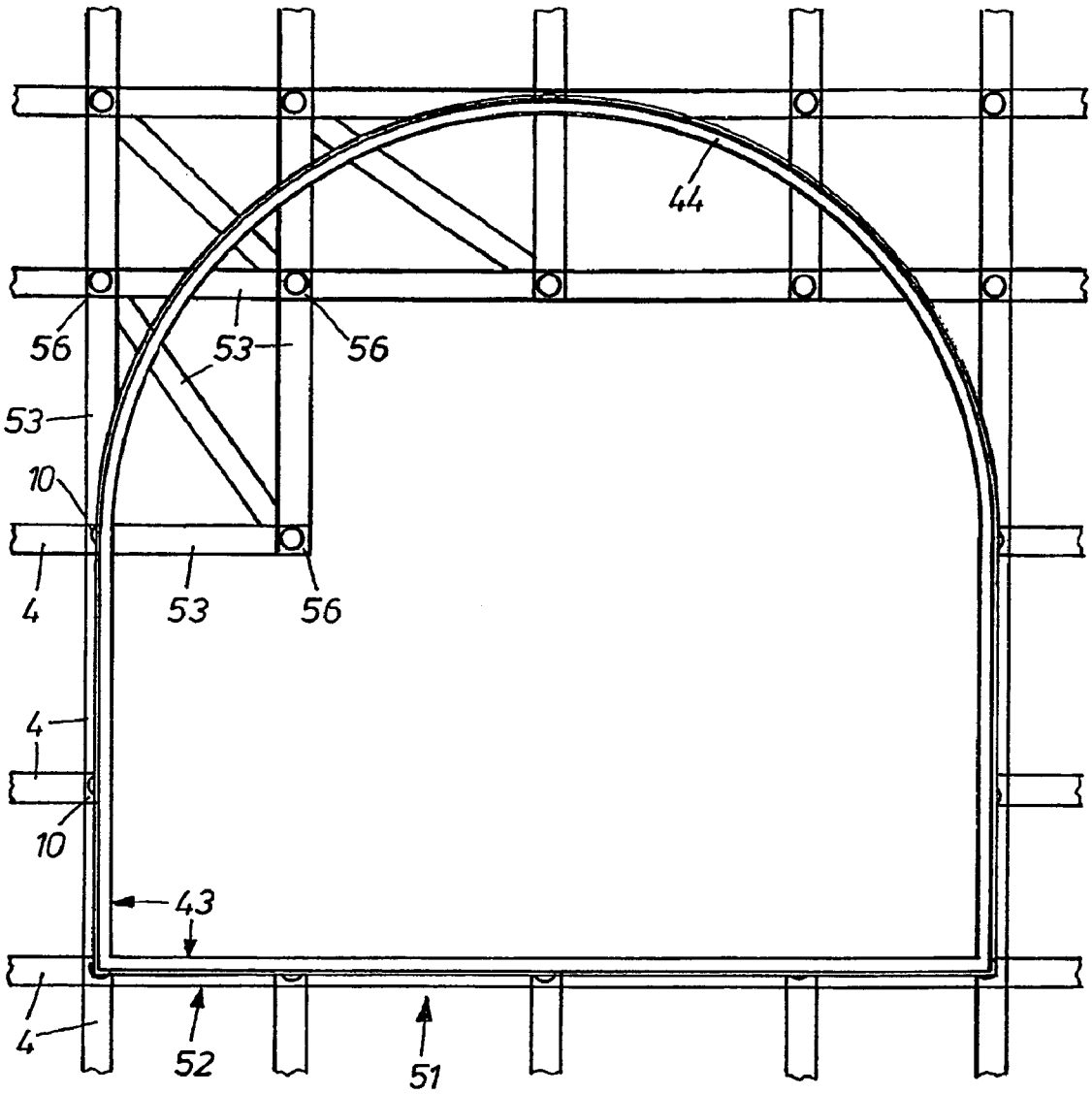
Figure 9:
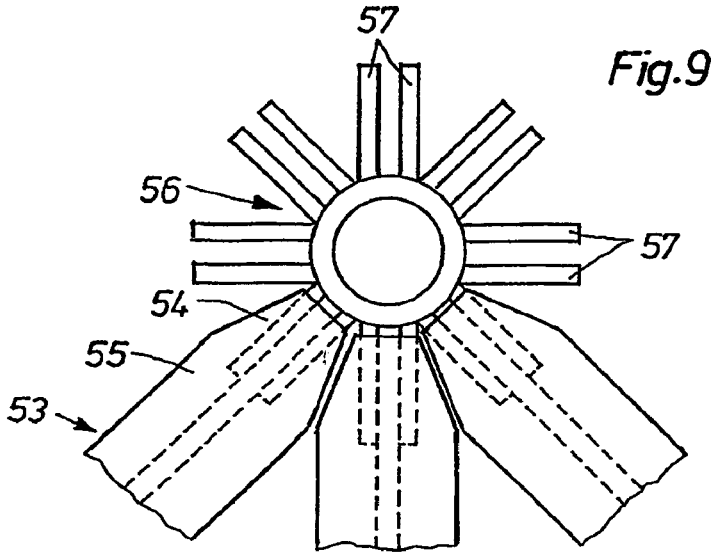

The invention is explained in greater detail in three drawings illustrating various embodiments. These show:

FIG. 1 a top view of a supporting structure for rectangular tree protection grilles and supporting grilles, FIG. 2 a side view of a supporting structure, FIG. 3 an enlarged partial cross-section of a tree protection grille and a supporting grille section resting on a supporting bar, FIG. 4 a side view of a coupling, FIG. 5 a top view of a coupling, FIG. 6 a top view of a supporting structure for a tree protection grille, used as a second example to illustrate an embodiment of this invention, FIG. 7 a side view of the supporting structure shown in FIG. 6, FIG. 8 a top view of a supporting structure comprising additional diagonal supporting bars, used as a third example to illustrate an embodiment of this invention, and FIG. 9 an enlarged top view of a coupling having additional connecting pieces.

Supporting structure 1 shown in FIGS. 1 and 2 essentially consists of a lower supporting frame 2 and an upper supporting frame 3. Both supporting frames 2 and 3 are made up of a large number of supporting bars 4, which in this embodiment of the invention are all straight and, apart from their length, have the same design characteristics.

The supporting bars 4 are made of double T sectional steel. As shown in FIGS. 4 and 5, they have a vertical web 5 and an upper and a lower horizontal web 6 and 7, respectively, the width of webs 6 and 7 conforming to half the thickness of supporting bar 4. The end sections of lower webs 7 are cut away. The sections of the vertical web 5 which protrude from the edges of the lower webs form a butt strap 8 extending in a vertical plane which is covered by the upper web 6. There are two boreholes 9 in butt straps 8.

Supporting bars 4 are connected by means of couplings 10. Coupling 10 consists of a pipe section 11 extending vertically, end plate 12 arranged on the face side and at the upper end of pipe section 11, and at least two plate elements disposed in pairs on the outside of pipe section 11 and extending essentially radially in a vertical plane, which are hereinafter referred to as twin straps 13. The distance between them is a little larger than the thickness of butt straps 8. The twin straps 13 have two boreholes 14 each, which correspond to the boreholes 9 in butt straps 8. The minimum number of two twin straps 13 may be arranged opposite or at right angles to each other. In addition, there are couplings 10 comprising three T-shaped or four cross-shaped twin straps 13.

Supporting bar 4 is connected with a coupling by slipping the corresponding butt strap 8 of supporting bar 4 between the twin straps 13 of coupling 10 and screwing them together with the aid of two screws 18 inserted through boreholes 9 and 14 and the corresponding nuts 19. Butt straps 8 and twin straps 13 constitute interacting connecting pieces.

As shown in FIGS. 1 and 2, several vertical posts 15 are disposed in a specific screen pattern and have welded-on base plates 16 with which they are propped up on bottom 17 of a pit not shown here. A first coupling 10 is pushed onto each post 15 which rests on base plate 16. Then the supporting bars 4 are fitted and screwed to the couplings 10, thus producing the lower supporting frame 2 mentioned before.

After the lower supporting frame 2 has been assembled, several spacers 20 are pushed onto posts 15. These are cube-shaped hollow supporting parts having openings for the passage of posts 15. The length of the edges of spacers 20 equals half the height or width of the supporting bars 4. In assembling, the length of posts 15 and the number of spacers 20 fitted must be adapted to each other in such a way that the end of post 15 protruding from the uppermost spacer 20 corresponds to the height of coupling 10. Then a second coupling 10 is pushed onto the protruding end of post 15 before supporting bars 4 of the upper supporting frame 3 are fitted and screwed up together with couplings 10.

As shown in FIG. 1, both supporting frames 2 and 3 made up of supporting bars 4 extending lengthwise and crosswise constitute a net-type supporting structure 1 in the pit mentioned earlier. This supporting structure has a large number of screen squares 21 and, located in the middle, a root protection space 22 for a tree not shown here. The root protection space 22 is covered with an unsupported tree protection grille 23 in a manner known generally, this grille being known in principle from Patent DE 197 07 355 A1, mentioned at the beginning, and Patent DE 199 40 911 C1. Tree protection grille 23, which in this embodiment is square in shape, consists of a number of square and rectangular grille sections 24, of which, for the sake of simplicity, only three are shown in the drawing. As may also be seen from FIG. 1, grille sections 24 have sides of different lengths which require the use of supporting bars 4 of different lengths for the construction of supporting structure 1. As a result, screen squares 21 differ in size, too.

The edge section of tree protection grille 23 rests on a border-strip frame 25. According to FIG. 3, it consists of several L-section bars 26 whose horizontal web 27 is a little wider than half the width of web 6 of supporting bar 4. Several brackets 29 are welded to the inside of vertical web 28. In the outer grille sections 24 the outer border web 30 of tree protection grille 23 is propped up on brackets 29 of border-strip frame 25. Brackets 29 are mounted at a height which ensures that the top surface of tree protection grille 23 will be in alignment with the top edge of vertical web 28.

And in addition the outside of the outer grille sections 24 is in alignment with the vertical center line of supporting bars 4 which supports them.

The screen squares 21 surrounding tree protection grille 23 are covered with flat supporting grilles 31, which are different in size to match the different-sized screen squares 21. The edges of supporting grilles 31 lie directly on supporting bars 4. On the underside of supporting grilles 31 positioning ridges are formed which run all around at a distance from the outer edges and are in engagement with the corresponding screen square 21. In this way they secure the position of the supporting grilles 31 on supporting bars 4 and at the same time keep the tree protection grille 23 from slipping out of place.

As may be seen from FIG. 3, supporting grilles 31 have a flat recess 33 in which a non-woven filter cloth 34 is placed. A layer of sand 35 is dumped onto the supporting grilles 31 covered with non-woven filter cloth 341 and then the pavement 36 is laid on the sand. The thickness of the layer of sand is dimensioned so that the top surface of pavement 36 is flush with the top surface of the tree protection grille 23.

As shown in FIG. 1, couplings 10 consisting of three T-shaped twin straps 13 where used along the left edge of supporting structure 1, whereas all the other couplings 10 consist of four cross-shaped twin straps 13. The use of couplings 10 having fewer than four twin straps 13 is appropriate when a supporting structure 1 is provided with a final border strip for structural or environmental reasons. Otherwise it is more expedient to use couplings 10 with four cross-shaped twin straps 13 in the border strip of a supporting structure 1. This makes it possible to enlarge supporting structure 1 at a later date without having to replace the outer couplings by other couplings. In this way, the supporting bars 4 required in addition can be connected right away with the twin straps 13 unused previously.

If care is taken when preparing the mounting of a supporting structure 1 that bottom 17 of the pit dug has an even surface, the supporting bars can be fitted so that the end sections of their upper web 6 rest on twin straps 13. This ensures that the supporting bars 4 will form an even surface and be reliably supported without having to make an additional adjustment.

However if the bottom 17 has no even surface, the supporting bars 4 have to be aligned vertically in order to obtain even-surfaced supporting frames 2 and 3. This results in a vertical clearance occurring between the end sections of the upper webs 6 of a smaller or larger number of supporting bars 4 and the twin straps 13. To provide for the vertical adjustability of supporting bars 4 the boreholes 9 and/or 14 may either be enlarged in diameter or elongated vertically. In this case a strong carrying force of supporting structure 1 may be obtained by roughening up or profiling the contacting surfaces of butt straps 8 and twin straps 13. In this way not only a frictional, but also a form-locking connection is obtained between supporting bars 4 and couplings 10 when screws 18 are tightened.

Other than that, all supporting bars 4 of both supporting frames 2 and 3 are positioned in one and the same plane, regardless of whether two, three or four supporting bars 4 are connected with one and the same coupling 10. As a result of this, maximum free spaces, i.e. openings 37, occur, as shown in FIG. 2, allowing the roots of a tree to grow practically unhindered.

Since openings 37 have the shape of regular rectangles or squares they can be closed completely in a comparatively easy manner for forming separating walls by filling them up with straight intermediate bars placed one on top of the other. As intermediate bars either supporting bars 4 or even-surfaced plates may be used. These plates must be fitted with strap-shaped connecting pieces at their ends which in form and size conform to butt straps 8 of the supporting bars 4. The intermediate bars are connected to twin straps 13 of additional couplings 10 pushed onto posts 15 in place of spacers 20.

Supporting structure 40, shown as a second embodiment of the invention in FIGS. 6 and 7, is designed for supporting a semi-circular tree protection grille 41. Just as tree protection grille 23, this grille constitutes an unsupported structure made up of several square and rectangular grille sections 24 as well as segment-shaped grille sections 42. The border area of tree protection grille 41 rests on a border-strip frame 43 which, in conformity with the outlines of tree protection grille 41, is made up of straight sectional bars 26 and an arc-shaped sectional bar 44.

Supporting structure 40 consists of a lower and an upper supporting frame 45 and 46, respectively, both comprising straight supporting bars 4 and arc-shaped supporting bars 47. Supporting bars 4 and 47 are connected with one another by couplings 10, just as in the first embodiment, which are pushed onto posts 15. Supporting structure 40 has a large number of rectangular or square screen squares 48 and an internal semi-circular root protection space 49. This is enclosed by straight supporting bars 4 and the arc-shaped supporting bars 47 mentioned earlier, which serve as a support for border-strip frame 43.

The arc-shaped supporting bars 47 are supported by additional posts 15*a* and connected with them by means of couplings 10. To ensure that the arc-shaped supporting bars 47 and couplings 10 fit smoothly, it is advisable to design the end sections of the vertical webs of these supporting bars 47 so that they extend parallel to the twin straps 13 of couplings 10.

As can be seen in FIG. 6, some of the arc-shaped supporting bars 47 overlap a total of four straight supporting bars 4*a*. For this reason the four supporting bars 4*a* are offset by the thickness of supporting bars 4 and 47, are arranged below the upper supporting frame 46 and are connected with additional couplings 10. The space required for these additional couplings 10 on the corresponding posts 15 is obtained by omitting two spacers 20.

As a result of this, supporting structure 40 is characterized by the fact that not only the straight sectional bars 26, but also the arc-shaped sectional bar 44 of border-strip frame 43 lie upon the corresponding straight and arc-shaped supporting bars 4 and 47, respectively, over their entire length. In this way a secure position of tree protection grille 41 on the upper supporting frame 46 is ensured.

The triangular corner areas 50 between the arc-shaped supporting frame 47 and the adjoining straight supporting bars 4 and 4*a* which form a right angle are covered by suitably shaped supporting grilles which are not shown. The concave-shaped border area of these supporting grilles rests on the arc-shaped supporting bars 47.

FIG. 7, which is a side view of supporting structure 40, shows that bottom 17 of the pit may be terraced, depending on the terrain features and the soil conditions. In this case care must be taken that the difference in height between the two levels of the terrace corresponds to the vertical dimension of spacer 20 or its multiple.

Having the same function as supporting structure 40, the supporting structure 51, shown in FIG. 8 as a third embodiment of the invention, is intended to support a semi-circular tree protection grille. Since this tree protection grille is designed just as tree protection grille 41, it is not shown here for the sake of simplicity. This tree protection grille also rests on a border-strip frame 43 which has an arc-shaped sectional bar 44 too.

Of supporting structure 51 only the upper supporting frame 52 is shown. This frame and the lower supporting frame, not illustrated, are made up partly of the supporting parts 4 used in the first and second embodiments of the invention, and partly of the slightly modified straight supporting bars 53. This modification pertains only to the end sections 54 of the upper webs 55, which have two slanted sides, as shown in FIG. 9.

In this way diagonal supporting bars 53 may be arranged in supporting frame 52 in the region of the arc-shaped sectional bar 44 in border-strip frame 43. These are connected to the corresponding posts 15 by means of couplings 56. The only difference between couplings 56 and couplings 10 is that their twin straps 57 form an angle of 45 degrees rather than 90 degrees. As is shown in FIG. 8, some of the screen squares, not specified further, of supporting frame 52 used in supporting structure 51 have a square shape, while others are rectangular. Since in the rectanglar screen squares the diagonal supporting bars 53 do not extend at an angle of 45 degrees to the supporting bars 4 extending lengthwise and crosswise, the end sections of the vertical webs of supporting bars 53 are designed so that they extend parallel to twin straps 57 arranged at an angle of 45 degrees. This makes it possible to join couplings 56 smoothly to supporting bars 53 which do not extend at an angle of 45 degrees.

Due to the arrangement of supporting bars 53 extending diagonally all arc-shaped sectional bars 44 are supported by a large number of intersecting supporting bars 53 extending lengthwise and crosswise, thus providing them and the entire tree protection grille with a secure foundation.

In addition, the diagonal supporting bars 53 improve the stability of the entire supporting structure 51. Since the diagonal supporting bars 53 are flush with supporting frame 52, the free spaces and openings for the passage of growing roots between the two supporting frames and the corresponding posts are not narrowed so that the roots of a tree can show without being hindered noticeably, as in the first example of the embodiment of this invention.

The invention claimed is:

1. A kit consisting of components for supporting tree protection grilles comprising a supporting frame and vertical support: said vertical support comprising vertical posts propped up on an underlying surface having spacers and a coupling which are slideably and removably received thereon, said couplings having a plurality of integral dual connecting pieces for receiving a complementary connecting piece of a supporting bar end therebetween, forming the supporting frame.

2. The kit according to claim 1 characterized in that a supporting frame section consisting of arc-shaped supporting bars is provided for supporting segment-shaped covering-grille sections positioned within a supporting frame made up of straight supporting bars extending lengthwise and crosswise, the arc-shaped supporting bars being positioned on the same level as the supporting frame, while the straight supporting bars intersecting with the arc-shaped supporting bars are offset in height with respect to the arc-shaped bars and are connected to the corresponding posts by means of a separate coupling connector.

3. The kit according to claim 2 characterized in that straight supporting bars extending diagonally are provided for supporting the segment-shaped covering grille sections within the supporting frame consisting of straight supporting bars extending lengthwise and crosswise in the region of the contour of the segment-shaped covering grille sections, the straight diagonal supporting bars being positioned on the same level as the supporting frame and connected with suitably designed couplings.

4. The kit according to claim 1, characterized in that the connecting pieces of the couplings and the supporting bars are designed as as the supporting which have at least one borehole so that they can be connected by means of screws.

5. The kit according to claim 4 characterized in that the coupling connector pieces comprise two spaced apart straps so that the strap integral to the supporting bar ends can be inserted between the two straps of the coupling connector pieces.

6. The kit according to claim 4 characterized in that the contact surfaces of the straps are roughened up or profiled.

7. The kit according to claim 4 characterized in that the couplings consist of a pipe section which can be pushed onto the posts, at least one end plate arranged on the face side and at the upper end of pipe section, and at least two single or twin straps fitted to the outside of pipe section.

8. The kit according to claim 1 characterized in that the supporting bars are made of double T sectional steel and the end sections of the vertical webs form straps.

9. The kit according to claim 7 characterized in that the supporting bars have the same thickness as the couplings, and supporting bars can be fitted vertically after removing the end sections of their lower horizontal web, and the top surface of the fitted supporting bars are flush with the end plate of the couplings.

10. The kit according to claim 3, characterized in that the connecting pieces of the couplings and the supporting bars are designed as straps extending vertically which have at least one borehole so that they can be connected by means of screws.

11. The kit according to claim 10 characterized in that the coupling connector pieces comprise two spaced apart straps so that the strap integral to the supporting bar ends can be inserted between the two straps of the coupling connector pieces.

12. The kit according to claim 11 characterized in that the contact surfaces of the straps are roughened up or profiled.

13. The kit according to claim 12 characterized in that the couplings consist of a pipe section which can be pushed onto the posts, at least one end plate arranged on the face side and at the upper end of pipe section, and at least two single or twin straps fitted to the outside of pipe section.

14. The kit according to claim 13 characterized in that supporting bars are made of double T sectional steel and the end sections of the vertical webs form straps.

15. The kit according to claim 14 characterized in that the supporting bars have the same thickness as the couplings, and supporting bars can be fitted vertically after removing the end sections of their lower horizontal web, and the top surface of the fitted supporting bars are flush with the end plate of the couplings.

* * * * *